US009238168B2

(12) United States Patent
Kloster et al.

(10) Patent No.: US 9,238,168 B2
(45) Date of Patent: Jan. 19, 2016

(54) SPLITBOARD JOINING DEVICE

(71) Applicants: Bryce M. Kloster, Seattle, WA (US); Tyler G. Kloster, Snoqualmie, WA (US)

(72) Inventors: Bryce M. Kloster, Seattle, WA (US); Tyler G. Kloster, Snoqualmie, WA (US)

( * ) Notice: Subject to any disclaimer, the term of this patent is extended or adjusted under 35 U.S.C. 154(b) by 55 days.

(21) Appl. No.: 13/763,453

(22) Filed: Feb. 8, 2013

(65) Prior Publication Data

US 2013/0214512 A1 Aug. 22, 2013

Related U.S. Application Data

(60) Provisional application No. 61/597,576, filed on Feb. 10, 2012.

(51) Int. Cl.
*A63C 5/02* (2006.01)
*A63C 5/03* (2006.01)

(52) U.S. Cl.
CPC ... *A63C 5/02* (2013.01); *A63C 5/03* (2013.01); *A63C 2203/06* (2013.01)

(58) Field of Classification Search
CPC ..... A63C 5/02; A63C 2203/06; A63C 5/03; A63C 5/031; A63C 5/16; A63C 10/14; Y10T 403/66; Y10T 403/595; Y10T 403/599; Y10T 403/62; Y10T 403/65; Y10T 403/7077
USPC ..... 280/603, 809, 818, 14.1
See application file for complete search history.

(56) References Cited

U.S. PATENT DOCUMENTS

| | | | |
|---|---|---|---|
| 31,259 | A | 1/1861 | Rich |
| 1,473,011 | A | 11/1923 | Christophel |
| 1,477,692 | A | 12/1923 | Chistophel |
| 2,660,812 | A | 12/1953 | Henke |
| 3,061,325 | A | 10/1962 | Glass |
| 3,171,667 | A | 3/1965 | Wightman |
| 3,439,928 | A | 4/1969 | Noguchi |
| 3,506,279 | A | 4/1970 | Lambert |
| 3,593,356 | A | 7/1971 | Schmalfeldt |
| 3,627,349 | A | 12/1971 | Barry |

(Continued)

FOREIGN PATENT DOCUMENTS

| | | |
|---|---|---|
| CH | 681 509 A5 | 4/1993 |
| DE | 89 03154.7 | 3/1989 |

(Continued)

OTHER PUBLICATIONS

Brochure for NITRO USA Snowboards. dated 1993-1994.

(Continued)

*Primary Examiner* — Paul N Dickson
*Assistant Examiner* — Bridget Avery
(74) *Attorney, Agent, or Firm* — Knobbe, Martens, Olson & Bear, LLP

(57) ABSTRACT

A splitboard joining device for releasably coupling at least two separate portions of a splitboard, thereby creating a snowboard when coupled and at least a first ski and a second ski when uncoupled. The device may include a first interface and a second interface for attaching to a first portion and a second portion, respectively, of the splitboard. In some embodiments, the device comprises an adjustable tension element disposed on either the first interface or second interface to adjustably control the tension between the first interface and second interface, and to adjustably control the compression between the first and second portions of the splitboard when coupled.

28 Claims, 8 Drawing Sheets

(56) References Cited

U.S. PATENT DOCUMENTS 3,677,566 A * 7/1972 Lawrence ..... 280/631
3,782,745 A 1/1974 Stoveken
3,861,698 A 1/1975 Greig
4,022,491 A 5/1977 Powell
4,062,553 A 12/1977 Riedel
4,085,528 A 4/1978 Delery
4,138,128 A 2/1979 Criss
4,163,565 A 8/1979 Weber
4,190,970 A 3/1980 Annovi
4,221,394 A 9/1980 Campbell
4,275,904 A 6/1981 Pedersen
4,403,785 A 9/1983 Hottel
4,428,608 A 1/1984 Cooke et al.
4,473,235 A 9/1984 Burt
4,547,981 A 10/1985 Thais et al.
4,652,007 A 3/1987 Dennis
4,700,967 A 10/1987 Meatto et al.
4,705,308 A 11/1987 Bisbing
4,728,116 A 3/1988 Hill
4,741,550 A 5/1988 Dennis
4,770,441 A 9/1988 Demonsant et al.
4,817,988 A 4/1989 Chauvet et al.
4,856,808 A 8/1989 Longoni
4,871,337 A 10/1989 Harris
4,949,479 A 8/1990 Ottieri
4,951,960 A 8/1990 Sadler
4,955,632 A 9/1990 Prestipino Giarritta et al.
4,973,073 A 11/1990 Raines et al.
4,979,760 A 12/1990 Derrah
4,982,733 A 1/1991 Broadhurst et al.
5,028,068 A 7/1991 Donovan
5,035,443 A 7/1991 Kincheloe
5,044,654 A 9/1991 Meyer
5,065,530 A 11/1991 Pozzobon et al.
5,065,533 A 11/1991 Paris
5,069,463 A 12/1991 Baud et al.
5,109,616 A 5/1992 Lush
5,145,202 A 9/1992 Miller
5,156,644 A 10/1992 Koehler et al.
5,249,816 A 10/1993 Southworth
5,299,823 A 4/1994 Glaser
5,344,179 A 9/1994 Fritschi et al.
5,397,150 A 3/1995 Commier et al.
5,462,318 A 10/1995 Cooke
5,499,461 A 3/1996 Danezin et al.
5,542,197 A 8/1996 Vincent
5,551,728 A 9/1996 Barthel et al.
5,553,883 A 9/1996 Erb
5,558,354 A 9/1996 Lion
5,570,522 A 11/1996 Olson et al.
5,618,051 A 4/1997 Kobylenski et al.
5,649,722 A 7/1997 Champlin
5,660,416 A 8/1997 Schiele et al.
5,697,631 A 12/1997 Ratzek et al.
5,701,689 A 12/1997 Hansen et al.
5,713,587 A 2/1998 Morrow et al.
5,741,023 A 4/1998 Schiele et al.
5,762,358 A 6/1998 Hale
5,765,853 A 6/1998 Erb
5,771,609 A 6/1998 Messmer
5,815,952 A 10/1998 Bobrowicz
5,816,590 A 10/1998 Fey et al.
5,820,139 A 10/1998 Grindl
5,884,933 A 3/1999 Trott
5,887,886 A 3/1999 Bourdeau
5,894,684 A 4/1999 Sand et al.
5,901,469 A 5/1999 Saillet
5,906,388 A 5/1999 Neiley
5,909,886 A 6/1999 Tugutaka et al.
5,937,546 A 8/1999 Messmer
5,941,552 A 8/1999 Beran
5,947,487 A 9/1999 Keleny et al.
5,966,843 A 10/1999 Sand et al.
5,966,844 A 10/1999 Hellerman et al.
5,979,082 A * 11/1999 Pallatin ..... 36/118.2
5,984,324 A 11/1999 Wariakois
5,984,325 A 11/1999 Acuna
6,000,711 A 12/1999 Fey et al.
6,015,161 A 1/2000 Carlson
6,041,721 A 3/2000 Weston
6,082,026 A 7/2000 Sand et al.
6,089,592 A 7/2000 Negus
6,105,992 A 8/2000 Schaller et al.
6,116,634 A 9/2000 Mometti
6,126,625 A 10/2000 Lundberg
6,138,384 A 10/2000 Messmer
6,206,402 B1 3/2001 Tanaka
6,231,057 B1 * 5/2001 Reuss et al. ..... 280/14.21
6,272,772 B1 8/2001 Sherman
6,276,708 B1 8/2001 Hogstedt
6,390,492 B1 * 5/2002 Bumgarner et al. ..... 280/607
6,464,237 B1 10/2002 Gracie
6,505,841 B1 1/2003 Kessler et al.
6,523,851 B1 2/2003 Maravetz
6,554,295 B2 * 4/2003 Rittmeyer ..... 280/11.3
6,578,865 B1 * 6/2003 Chaput ..... 280/617
6,609,720 B2 * 8/2003 Marmonier ..... 280/14.24
6,616,151 B1 9/2003 Golling
6,648,365 B1 * 11/2003 Laughlin et al. ..... 280/624
6,729,642 B2 * 5/2004 Gouzes et al. ..... 280/623
6,733,030 B2 5/2004 Okajima et al.
6,786,502 B2 * 9/2004 Carlson ..... 280/633
6,792,702 B2 9/2004 Borsoi et al.
6,863,285 B2 * 3/2005 Gonthier ..... 280/14.22
6,969,075 B2 * 11/2005 Dean et al. ..... 280/14.22
7,029,023 B2 4/2006 Fougere
7,073,813 B2 7/2006 Martin et al.
7,097,194 B2 8/2006 Kogler
7,147,233 B2 12/2006 Edmond
7,204,495 B2 * 4/2007 Reuss et al. ..... 280/11.36
7,207,592 B2 4/2007 Pascal et al.
7,232,147 B2 6/2007 Courderc
7,246,811 B2 7/2007 Martin
7,267,357 B2 9/2007 Miller et al.
7,306,241 B2 12/2007 Cunningham et al.
7,320,474 B2 1/2008 Quellais et al.
7,367,579 B2 5/2008 Elkington
7,427,079 B2 9/2008 Piva
7,503,579 B2 3/2009 Courderc
7,516,976 B2 4/2009 Cunningham et al.
7,568,719 B2 8/2009 Sauter
7,621,542 B2 * 11/2009 Warburton et al. ..... 280/14.22
7,669,880 B2 3/2010 Doyle et al.
7,681,904 B2 3/2010 Ekberg
7,694,994 B2 4/2010 Lang et al.
7,823,905 B2 11/2010 Ritter
7,832,754 B2 11/2010 Girard et al.
7,931,292 B2 4/2011 Miralles
7,992,888 B2 * 8/2011 Steere ..... 280/624
8,033,564 B2 10/2011 Riepler et al.
8,132,818 B2 3/2012 Cunningham et al.
8,167,321 B2 5/2012 Cunningham et al.
8,226,109 B2 7/2012 Ritter
8,348,299 B2 1/2013 Ekberg
8,371,605 B2 2/2013 Neiley et al.
8,469,372 B2 6/2013 Kloster et al.
8,480,546 B2 7/2013 Spencer
8,662,505 B2 3/2014 Cunningham et al.
8,684,394 B2 4/2014 Smith
8,708,371 B2 4/2014 Balun
8,720,910 B2 5/2014 Caslowitz
8,733,783 B2 5/2014 Kloster et al.
8,764,043 B2 7/2014 Neubauer et al.
8,857,845 B2 10/2014 Ohlheiser
2004/0061311 A1 4/2004 De Bortoli et al.
2004/0169343 A1 9/2004 Fougere
2005/0057009 A1 3/2005 Courderc
2005/0161911 A1 7/2005 Piva
2005/0177083 A1 8/2005 Heil
2005/0253347 A1 11/2005 Martin et al.
2006/0175802 A1 8/2006 Maravetz et al.
2007/0170697 A1 7/2007 Courderc
2007/0216137 A1 9/2007 Ritter
2008/0185814 A1 8/2008 Riepler et al.

(56) References Cited

U.S. PATENT DOCUMENTS

| | | | |
|---|---|---|---|
| 2009/0146396 | A1 | 6/2009 | Hahnenberger |
| 2009/0250906 | A1 | 10/2009 | Ritter |
| 2010/0102522 | A1 | 4/2010 | Kloster et al. |
| 2010/0304937 | A1 | 12/2010 | Spencer |
| 2011/0184326 | A1 | 7/2011 | Ingimundarson et al. |
| 2011/0197362 | A1 | 8/2011 | Chella et al. |
| 2011/0254251 | A1 | 10/2011 | Jung |
| 2012/0256395 | A1 | 10/2012 | Ritter |
| 2012/0274036 | A1 | 11/2012 | Kloster et al. |
| 2012/0292887 | A1 | 11/2012 | Ohlheiser |
| 2013/0147159 | A1 | 6/2013 | Neiley et al. |
| 2013/0277947 | A1 | 10/2013 | Kloster et al. |
| 2014/0167392 | A1 | 6/2014 | Kloster et al. |
| 2014/0210187 | A1 | 7/2014 | Ritter |
| 2014/0232087 | A1 | 8/2014 | Bulan |
| 2014/0291965 | A1 | 10/2014 | Kloster et al. |
| 2015/0014962 | A1 | 1/2015 | Rayner |
| 2015/0021881 | A1 | 1/2015 | Hutchison |
| 2015/0048597 | A1 | 2/2015 | Tudor |

FOREIGN PATENT DOCUMENTS

| | | | |
|---|---|---|---|
| DE | 91 08 618.3 | | 1/1992 |
| DE | 296 18 514 | U1 | 10/1996 |
| EP | 0 362 782 | A2 | 4/1990 |
| EP | 0 680 775 | B1 | 11/1995 |
| WO | WO 98/17355 | | 4/1998 |

OTHER PUBLICATIONS

Web page showing Salomon SNS Pilot Combi binding, www.salomon.com/us/products/sns-pilot-combi.html, dated Mar. 20, 2012.

U.S. Appl. No. 12/604,256, filed Oct. 22, 2009, including its prosecution history.

U.S. Appl. No. 13/458,560, filed Apr. 27, 2012, including its prosecution history.

U.S. Appl. No. 14/287,938, filed May 27, 2014, including its prosecution history.

U.S. Appl. No. 13/915,370, filed Jun. 11, 2013, including its prosecution history.

U.S. Appl. No. 13/925,546, filed Jun. 24, 2013, including its prosecution history.

* cited by examiner

SPLITBOARD JOINING DEVICE

CROSS-REFERENCE TO RELATED APPLICATIONS

This application claims the benefit of, and priority to, U.S. Provisional Application Ser. No. 61/597,576, filed on Feb. 10, 2012, entitled "BOARD CLIP JOINING DEVICE," which is incorporated herein by reference in its entirety.

BACKGROUND

The present disclosure generally relates to split snowboards, also known as splitboards, and includes the disclosure of splitboard joining devices relating to, or configured to be used with, a splitboard for converting the splitboard between a snowboard for riding downhill in ride mode and touring skis for climbing up hill in tour mode. The present disclosure also includes systems and methods relating to splitboard joining devices.

Splitboards are used for accessing backcountry terrain. Splitboards have a "ride mode" and a "tour mode." In ride mode, the splitboard is configured with at least two skis held together to form a board similar to a snowboard with bindings mounted somewhat perpendicular to the edges of the splitboard. In ride mode, a user can ride the splitboard down a mountain or other decline, similar to a snowboard. In tour mode, the at least two skis of the splitboard are separated and configured with bindings that are typically mounted like a cross country free heel ski binding. In tour mode, a user normally attaches skins to create traction when climbing up a hill. In some instances, additional traction beyond what the skins provide is desirable and crampons are used. When a user reaches the top of the hill or desired location the user can change the splitboard from tour mode to ride mode and snowboard down the hill.

With the growth of splitboarding in recent years, users seek to achieve solid snowboard performance and flex profile from their splitboards to allow them to ride more challenging terrain. An important component in achieving solid snowboard performance and flex profile is the joining device used to combine the at least two skis into a snowboard. One existing technology passively joins the two skis into a snowboard and does not provide any tensile or compressive preload to the splitboard. This passive attachment can wear over time to create slop in the seam of the splitboard. Slop in the seam of a splitboard creates a lag in board responsiveness and poor edge control and can lead to difficulty in turning and speed control. Existing technology does not allow for a user to adjust the joining device to create more tensile and compressive forces. The two main causes of slop in the seam of a splitboard are wear and manufacturing tolerances.

There is a need in the art for a splitboard joining device which pre-loads a splitboard in both directions parallel to the seam, in both directions perpendicular to the seam, and in both directions vertically from the seam. Additionally, there is a need for a splitboard joining device which is adjustable to increase or decrease tensile and compressive forces in a splitboard.

SUMMARY

Some embodiments disclosed herein provide a splitboard joining device for releasably coupling at least two separate portions of a splitboard, creating a snowboard when coupled and at least a first ski and a second ski when uncoupled. The device may comprise a first interface configured to attach to a first portion of a splitboard, the first interface having at least one hook element and at least one tab element, and the at least one tab element extending past the inside edge of the first portion of a splitboard and over the second portion of a splitboard to limit upward movement of the second portion of the splitboard. The splitboard joining device can comprise a second interface configured to attach to a second portion of a splitboard, the second interface having at least one latch element and at least one tab element, and the at least one tab element extending past the inside edge of the second portion of the splitboard and over the first portion of the splitboard to limit upward movement of the first portion of the splitboard. The latch element of the second interface can be configured to engage the hook element of the first interface to releasably couple the at least two portions of a splitboard. The at least one latch element can comprise a lever rotating about a pivot for engaging and disengaging by hand without the use of an external tool the latch element of the second interface with the hook element of the first interface. The splitboard joining device may comprise an adjustable tension element on either the first interface or the second interface to adjustably control the tension between the first interface and second interface, and to adjustably control the compression between the first and second portions of the splitboard when coupled.

In some embodiments, when the first and second interface are coupled, the act of coupling creates tension between the first interface and second interface, creates compression between at least the first splitboard portion and second splitboard portion, creates compression between a first portion of a splitboard and the second interface, and/or creates compression between a second portion of a splitboard and the first interface.

For purposes of the present disclosure and summarizing distinctions from the art, certain aspects of the apparatus, systems, and methods have been described above and will be described further below. Of course, it is to be understood that not necessarily all such aspects may be present in any particular embodiment. Thus, for example, those skilled in the art will recognize that the apparatus, systems, and methods may be embodied or carried out in a manner that achieves or optimizes one aspect or group of aspects as taught herein without necessarily achieving other aspects as may be taught or suggested herein. All of these embodiments are intended to be within the scope of the present disclosure herein disclosed.

BRIEF DESCRIPTION OF THE DRAWINGS

These and other features, aspects, and advantages of the disclosed apparatus, systems, and methods will now be described in connection with embodiments shown in the accompanying drawings, which are schematic and not necessarily to scale. The illustrated embodiments are merely examples and are not intended to limit the apparatus, systems, and methods. The drawings include the following figures, which can be briefly described as follows.

DETAILED DESCRIPTION

Figure 1A:
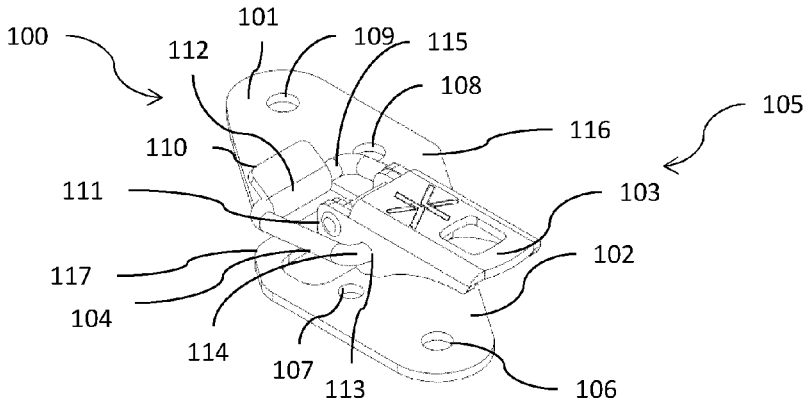
FIG. 1A is an isometric view of an embodiment of a board joining device in a coupled position.

FIGS. 1A-1F illustrate an embodiment of a board joining device 100. In particular, FIG. 1A illustrates an isometric view of the board joining device 100. As shown, the board joining device 100 can include a buckle element 105 and a hook element 101. In one embodiment, the buckle element 105 can include a base 102 with a shear tab 117, mounting holes 106 and 107, and a pivot 111. A cam lever 103 may be pivotally attached at the pivot 111. A loop 104 may also be pivotally attached to the cam lever 103 at the pivot hole 113. The loop 104 can comprise a pivot attachment 114 and a hook attachment 115. In one implementation, the hook element 101 can include a hook 112, a hook lead-in 110, mounting holes 109 and 108, and a shear tab 116.

In one embodiment, the hook element 101 can be attached with a screw, rivet, or any fastening element through mounting holes 109 and 108 to a first ski (not shown) and the buckle element 105 can be attached can be attached with a screw, rivet, or any fastening element through mounting holes 106 and 107 to a second ski (not shown). In a further implementation, a user can join the first and second skis by engaging the hook element 101 and buckle element 105 to create a snowboard.

Figure 1B:
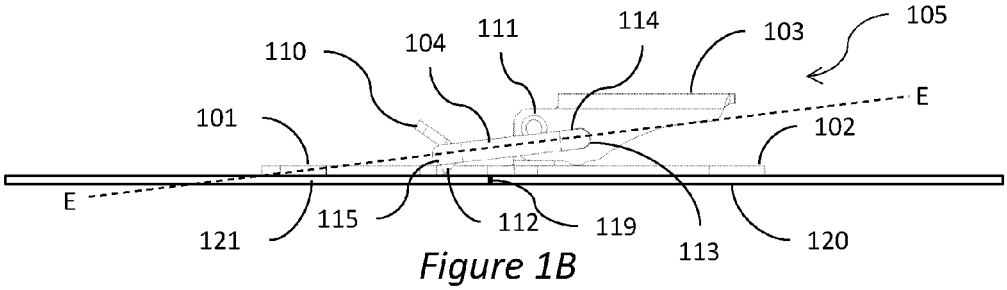
FIG. 1B is a side view of an embodiment of the board joining device in a coupled position.

FIG. 1B shows a side view of the board joining device 100 of FIG. 1A with the hook element 101 and the buckle element 105 engaged. The hook attachment 115 of the loop 104 engages the hook 112 of the hook element 101. In particular, when the loop 104 of the buckle element 105 engages the hook 112 of the hook element 101 and the cam lever 103 is in the over-center position, a first ski 121 and a second ski 120 compress together at a seam 119 to create a snowboard. In addition, the loop 104 may be in tension between the hook 112 and the pivot hole 113. The over-center position may be defined by the pivot attachment 114 and the hook attachment 115 of the loop 104 being below the pivot 111 of the base 102. In a further implementation, the loop 104 is in tension along the line of action "E" pulling the first ski 121 up into a shear tab 117 of the buckle element 105 and the second ski 120 into the shear tab 116 of the hook element 101 (seen in FIG. 1A). This configuration creates horizontal compression between the first and second skis 121 and 120, vertical compression between the first ski 121 and the shear tab 117 of the buckle element 105, and vertical compression between the second ski 120 and the shear tab 116 of the hook element 101. The use of tension between the buckle element 105 and the hook element 101, the use of horizontal compression between the first and second skis 120 and 121, the use of vertical compression between the first ski 121 and the shear tab 117 of the buckle element 105, and/or the use of vertical compression between the second ski 120 and the shear tab 116 of the hook element 101 creates preload in a splitboard 500 (shown in FIGS. 5A and 5B) to actively join first and second skis 120 and 121. The preload described above prevents relative motion in both directions along path J (shown in FIG. 6B) parallel to the seam 119, both directions along path G (shown in FIGS. 6A and 6B) perpendicular to seam 119 and both directions along path H (shown in FIG. 6A) vertically between the first and second skis 120 and 121. This combination of tension and compression elements allows longitudinal and torsional flex to be transmitted from the second ski 120 to first ski 121, thereby providing a user solid snowboard performance and flex profile from a splitboard.

A benefit of using a loop 104 in a buckle element 105 over other tension arm embodiments is that the loop 104 transmits loads axially along path E without any bending loads, thus allowing smaller and lighter weight tensioning arms with higher tension to weight ratios. A tension arm that transmits axial and bending loads would have a lower tension to weight ratio and larger volume to achieve the same tension as with the loop 104 of FIGS. 1A and 1B. A larger volume tensioning arm can also attract more snow build up and cause the splitboard to be heavier. Weight is a major factor in splitboarding as the user carries all the weight up and down the hill.

Figure 1C:
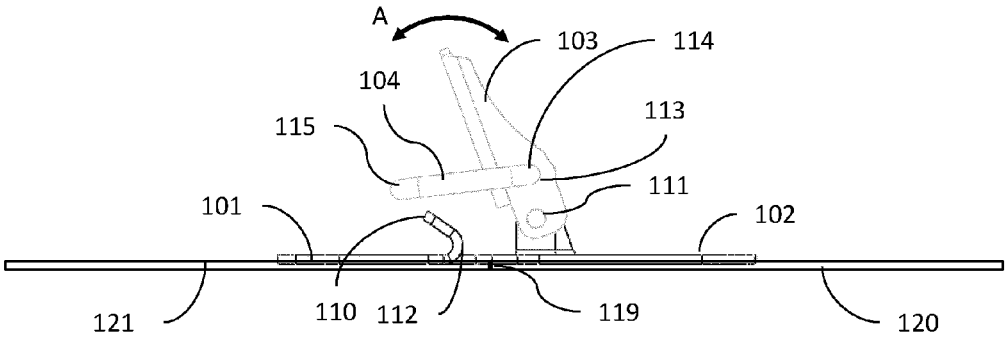
FIG. 1C is a side view of an embodiment of the board joining device in an uncoupled position.

FIG. 1C shows a side view of the board joining device 100 with the hook element 101 and the buckle element 105 disengaged. The cam lever 103 of the buckle element 105 is rotated up along path "A" causing the hook attachment 115 of the loop 104 to disengage the hook 112 of the hook element 101.

Figure 1D:
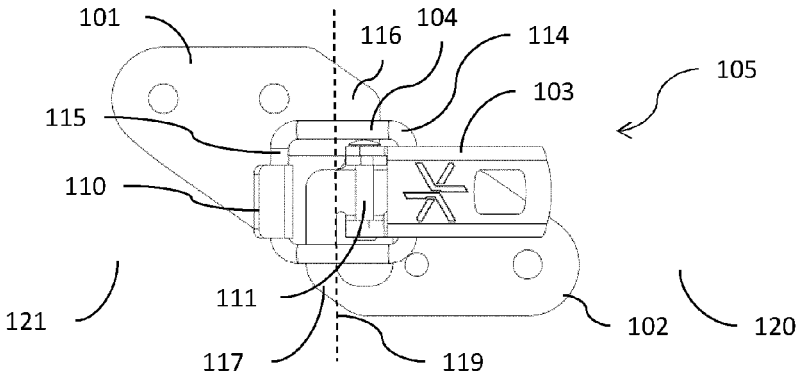
FIG. 1D is a top view of an embodiment of the board joining device in a coupled position.

FIG. 1D shows a top view of the board joining device 100. The shear tab 116 of the hook element 101 extends across the seam 119 created by the first and second skis 121 and 120, which are shown in FIG. 1B. The shear tab 117 of the buckle element 105 also extends across the seam 119 created by the first and second skis 121 and 120 (shown in FIG. 1B). The shear tabs 116 and 117 prevent vertical movement of the first and second skis 121 and 120.

Figure 1E:
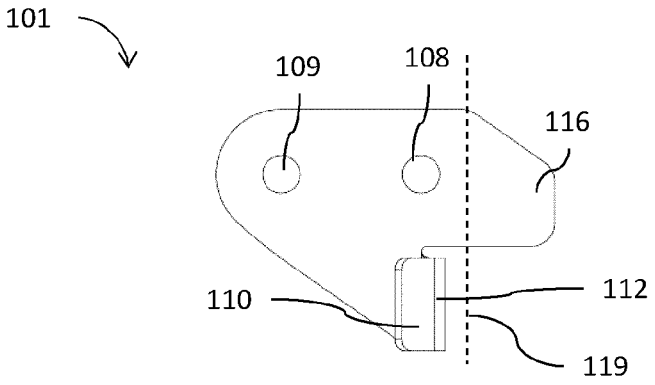
FIG. 1E is a top view of an embodiment of a hook element of the board joining device.
Figure 1F:
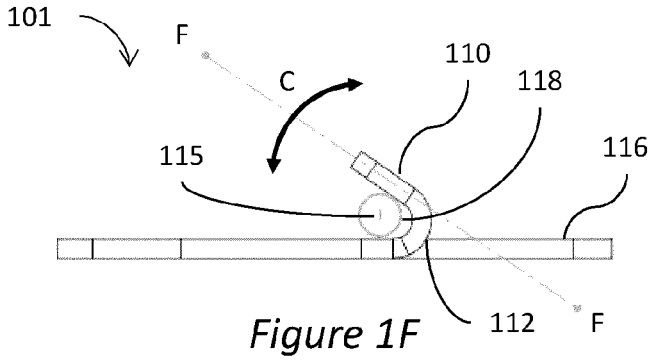
FIG. 1F is a side view of an embodiment of the hook element of the board joining device with the hook in a neutral position.
Figure 1G:
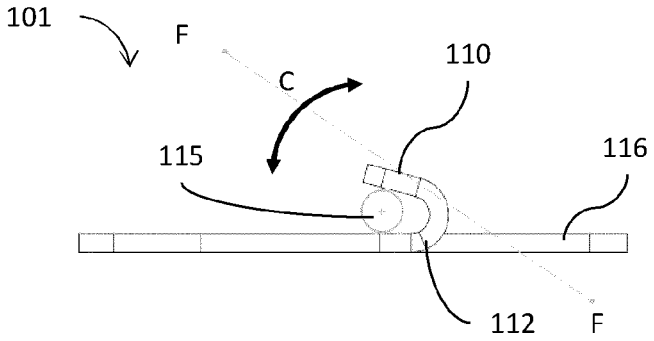
FIG. 1G is a side view of an embodiment of the hook element of the board joining device with the hook in a position to increase the tension when the board joining device is in a coupled configuration.
Figure 1H:
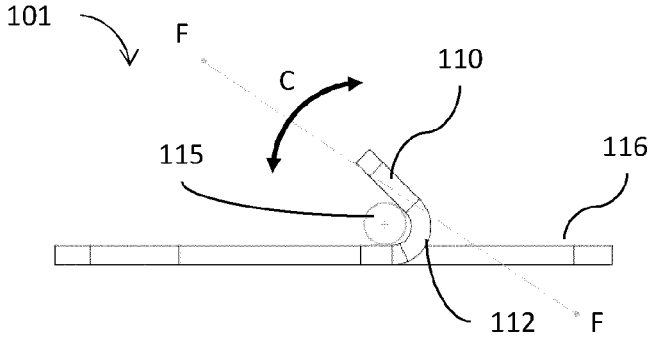
FIG. 1H is a side view of an embodiment of the hook element of the board joining device with the hook in a position to decrease the tension when the board joining device is in a coupled configuration.

FIGS. 1E through 1H illustrate views of the hook element 101 of the board joining device 100. FIG. 1E is a top view of hook element 101. FIG. 1F is a side view of the hook element 101, with shows the hook 112, the hook extension 110, and the shear tab 116. In one implementation, the hook element 101 can be made of a material such as steel, stainless steel, aluminum alloy, magnesium alloy, and/or titanium alloy such that the hook extension 110 is stiff enough to withstand the tension load, without yielding, of the loop 104 described in FIG. 1B and can also be adjusted along path "C" to increase or decrease the tension loop 104. Adjusting the loop extension 110 down along path "C" past nominal position "F" increases tension in the loop 104 by decreasing the radius of the hook 112, which is shown, for example, in FIG. 1G. Conversely, adjusting loop extension 110 up along path "C" past nominal position "F" decreases tension in the loop 104 by decreasing the radius of the hook 112, which is shown, for example, in FIG. 1H.

In some embodiments, the hook element 101 can have a shim 118 added to the hook 112 to increase the tension in the loop 104. An embodiment of the shim 118 is illustrated, for example, in FIG. 1F. The shim 118 can be made of hard durometer materials or soft durometer materials to adjust the tension in the loop 104. The shim 118 can also be made of materials of different thickness to adjust the tension in the loop 104.

Reference is now made to FIGS. 2A-2F, which illustrates another set of embodiments of a board joining device 200 in accordance with the present disclosure. The board joining device 200 of FIGS. 2A-2F may be similar in some respects to the board joining device 100 illustrated in FIGS. 1A-1F and described in more detail above, wherein certain features described above will not be repeated with respect to the embodiments of FIGS. 2A-2F. Like components may be given like reference numerals.

Figure 2A:
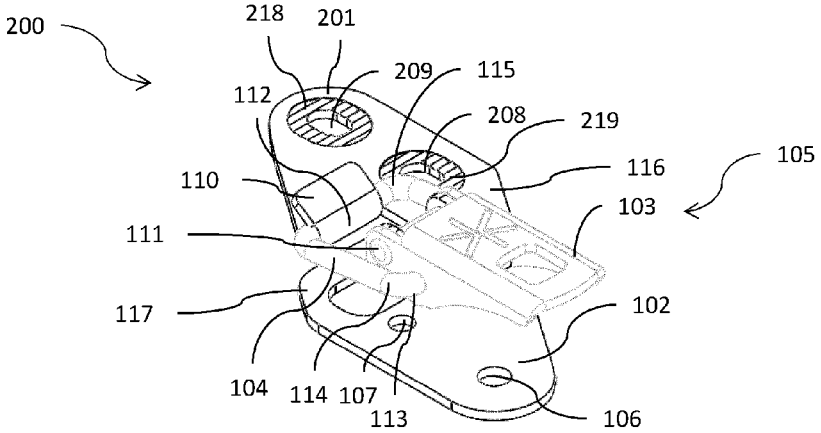
FIG. 2A is an isometric view of a second embodiment of a board joining device in a coupled position.

FIG. 2A is an isometric view of the board joining device 200, which can include a hook element 201 and a buckle element 105. The hook element 201 can include slotted mounting holes 208 and 209 and grip teeth 218 and 219. The purpose of the slotted mounting holes 208 and 209 is to adjust the tension between the hook element 201 and the buckle element 105 through the loop 104 by increasing or decreasing the mounted distance between the hook element 201 and the pivot 111 and/or pivot 113 of the buckle element 105.

Figure 2B:
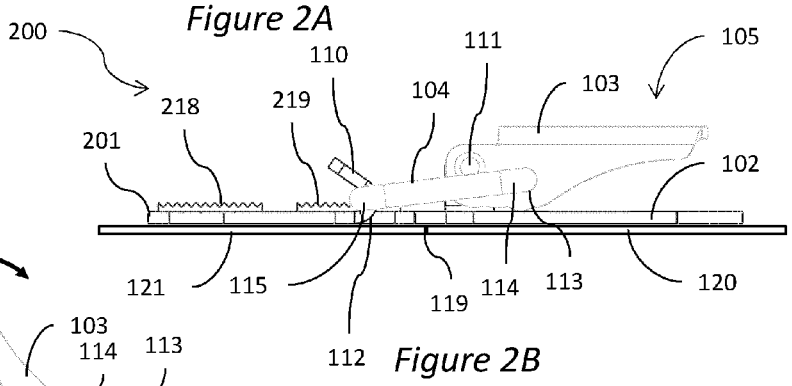
FIG. 2B is a side view of a second embodiment of the board joining device in a coupled position.
Figure 2C:
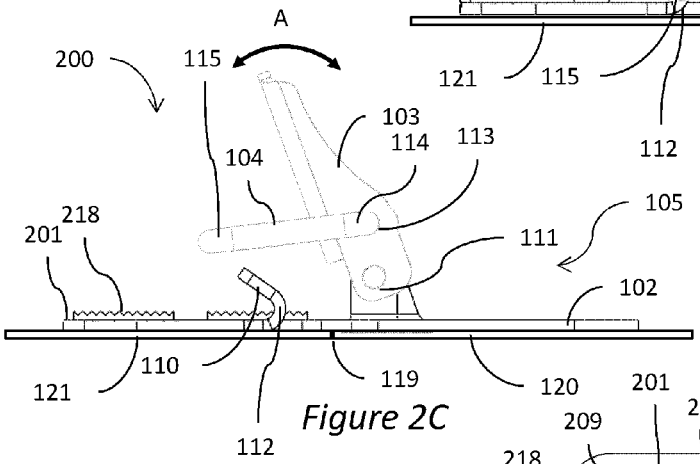
FIG. 2C is a side view of a second embodiment of the board joining device in an uncoupled position.
Figure 2D:
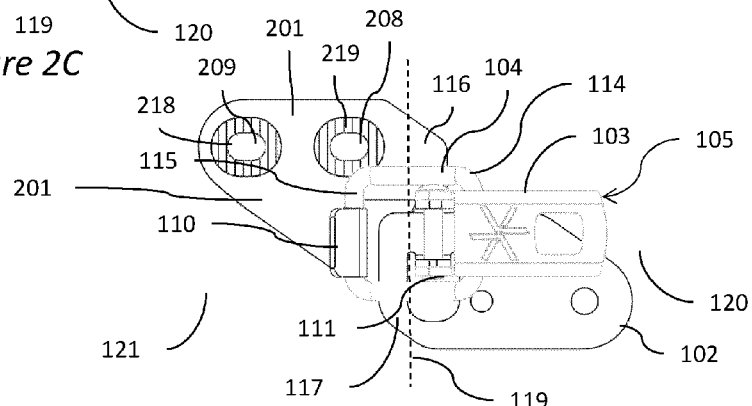
FIG. 2D is a top view of a second embodiment of the board joining device in a coupled position.

FIGS. 2B through 2D show additional views and configurations of the board joining devices 200. For example, FIG. 2B is a side view of the board joining device 200 with the hook element 201 and the buckle element 105 engaged. This side view shows a possible profile of the grip teeth 218 and 219 of the hook element 201. The grip teeth 218 and 219 can be formed, molded, forged, glued, welded, adhered, taped or any other form of fastening to the hook element 201. The grip teeth 218 and 219 can also be a knurled surface, textured surface, or any of the like to increase friction between the grip teeth 218 and 219 and fastening elements, such as screws 222 and 223 (shown in FIGS. 2E and 2F). FIG. 2C shows a side view of the board joining device 200 with the hook element 201 and the buckle element 105 disengaged. FIG. 2D shows a top view of the board joining device 200.

Figure 2E:
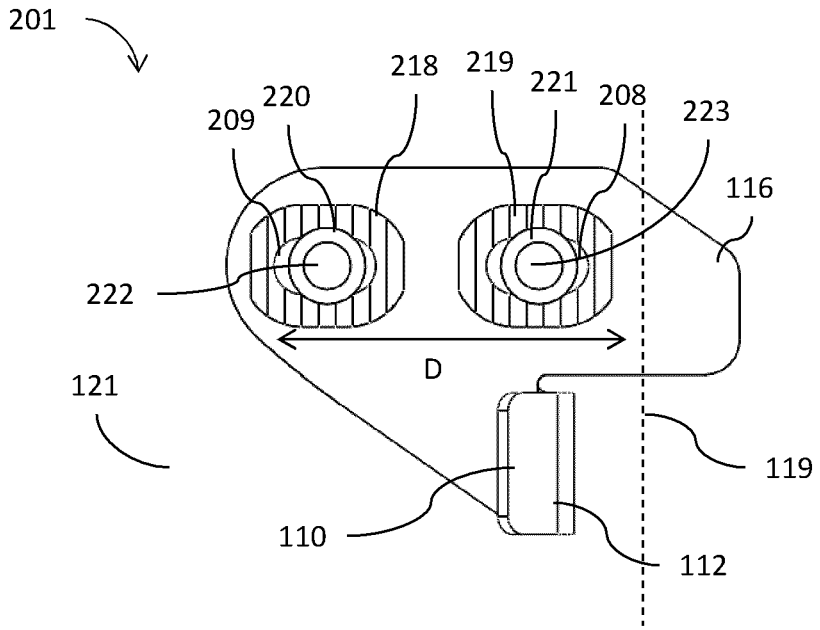
FIG. 2E is a top view of a second embodiment of the hook element of the board joining device.

FIG. 2E shows a detailed top view of the hook element 201 of the board joining device 200. The hook element 201 can be mounted to a first ski 121 with a first screw 222 and a second screw 223. The first screw 222 can be positioned within a first slot 209 with a first toothed spacer 220. The first spacer 220 grips into grip teeth 218 when the first screw 222 is tightened constraining the horizontal motion of the hook element 201 relative to the first screw 222. Similarly, the second screw 223 can be positioned within a second slot 208 with a second toothed spacer 221. The second spacer 221 grips into grip teeth 219 when the second screw 223 is tightened constraining the horizontal position of the hook element 201 relative to second screw 223. To increase tension between the hook element 201 and the buckle element 105 (see FIG. 2A) the first and second screws 222 and 223 may be loosened and the hook element 201 can be moved along path "D" such that the hook 112 of the hook element 201 is an increased distance from the seam 119 of the splitboard. When the desired tension is achieved, the first and second screws 222 and 223 may be tightened. The positions of the screws 222 and 223 can be fixed relative to the seam 119. In some embodiments, the first and second spacers 220 and 221 do not have teeth. The spacers 220 and 221 can be made from materials with a high coefficient of friction, soft materials such as aluminum or magnesium, or many other materials such that when compressed onto the grip teeth 218 and 219 sufficient friction is created to resist any loads which would cause the hook element 201 to move along the slotted mounting holes 208 and 209. The slotted mounting holes 208 and 209 can be on either the hook element 201 or the buckle element 105. The pivot 111 of the base 102 can be a separate component which can be moved relative to the base 102 to increase or decrease tension between the hook element 101 and the buckle element 105. The spacers 220 and 221 are not required and the mounting screws 222 and 223 can have similar characteristics to the spacers 220 and 221 to create sufficient friction to resist any loads which would cause the hook element 201 to move along the slotted mounting holes 208 and 209.

Figure 2F:
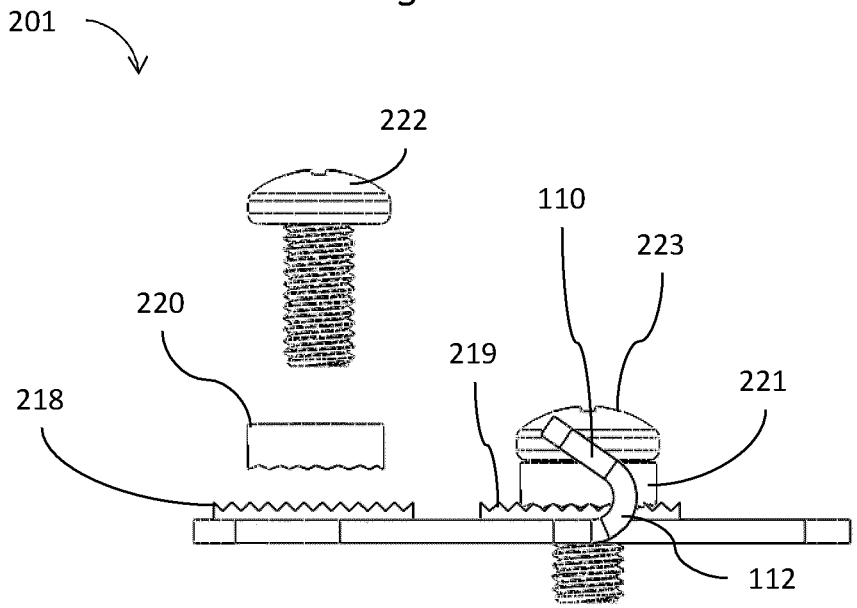
FIG. 2F is a side view of a second embodiment of the hook element of the board joining device.

FIG. 2F is a detailed side view of the hook element 201 with the first screw 222 and the first spacer 220 in an exploded view for clarity. In some embodiments, the first spacer 220 can have teeth on a bottom side to engage the grip teeth 218 of the hook element 201. In other embodiments, however, the first spacer 222 may not necessarily have teeth. The second screw 223 and the second spacer 221 may have a similar configuration. In other embodiments, however, the second screw 223 and/or the second spacer 221 may have a different structure and/or configuration from the first screw 222 and/or the first spacer 220.

Reference is now made to FIGS. 3A-3D, which illustrates another set of embodiments of a board joining device 300 in accordance with the present disclosure. The board joining device 300 of FIGS. 3A-3D may be similar in some respects to the board joining device 100 illustrated in FIGS. 1A-1F and described in more detail above, wherein certain features described above will not be repeated with respect to the embodiments of FIGS. 3A-3D. Like components may be given like reference numerals.

Figure 3A:
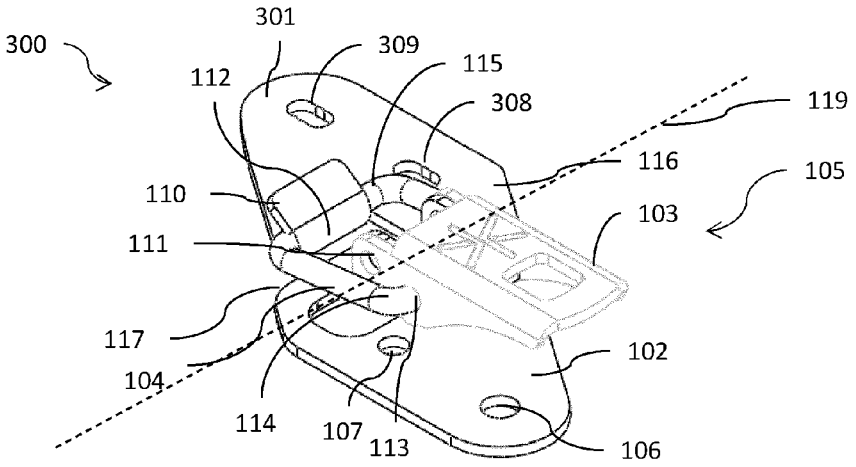
FIG. 3A is an isometric view of a third embodiment of a board joining device in a coupled position.
Figure 3B:
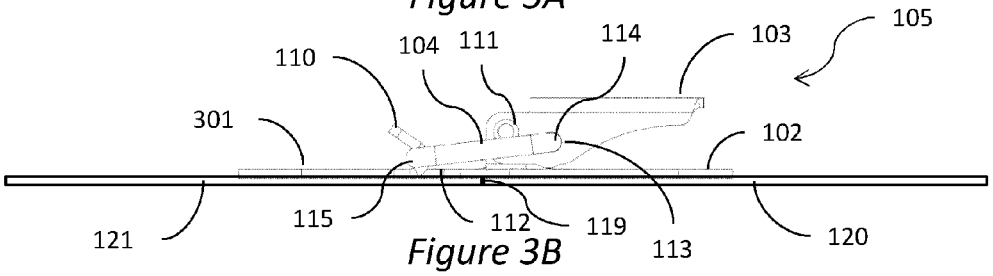
FIG. 3B is a side view of a third embodiment of the board joining device in a coupled position.
Figure 3C:
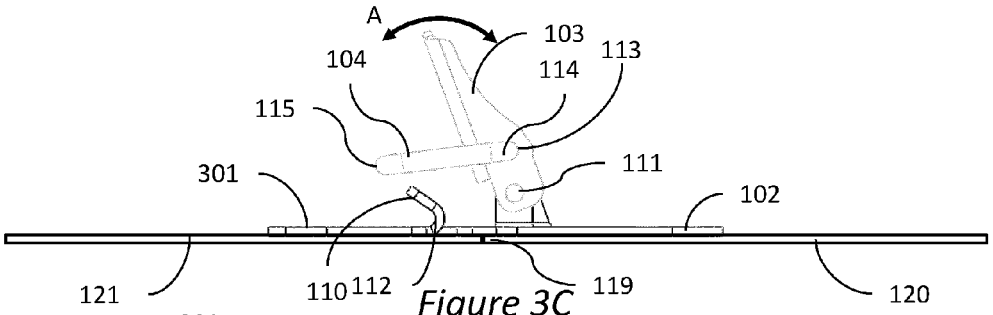
FIG. 3C is a side view of a third embodiment of the board joining device in an uncoupled position.

FIG. 3A is an isometric view of the board joining device 300, which can include a hook element 301 and a buckle element 105. The hook element 301 can include scalloped slotted mounting holes 308 and 309. FIG. 3B illustrates a side view of board joining device 300 in an engaged position, while FIG. 3C shows a side view of board joining device 300 in a disengaged position.

Figure 3D:
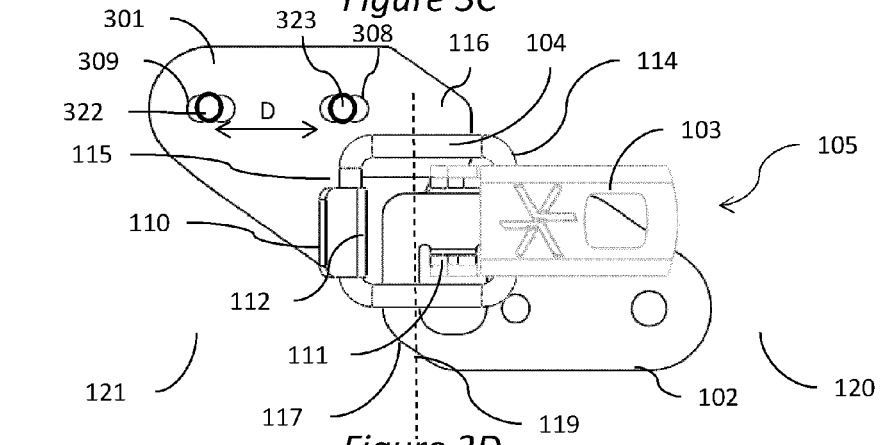
FIG. 3D is a top view of a third embodiment of the board joining device in a coupled position.

FIG. 3D is a top view of the board joining device 300 of FIG. 3A. Tension between the hook element 301 and the buckle element 105 can be increased by moving the hook element 301 along path "D", thereby moving the hook 112 away from seam the 119 of the splitboard. The scallops in a first scalloped slot 309 engaging on a first screw 322 may be configured to horizontally constrain and position the hook element 301 relative to the first screw 322. Similarly, the scallops in a second scalloped slot 308 engaging on a second screw 323 may be configured to horizontally constrain and position the hook element 301 relative to the second screw 323. The positions of the first and second screws 322 and 323 can be fixed relative to seam 119 of the splitboard.

Reference is now made to FIGS. 4A-4F, which illustrates an additional set of embodiments of a board joining device 400 in accordance with the present disclosure. The board joining device 400 may be similar in some respects to the board joining device 100 illustrated in FIGS. 1A-1F and described in more detail above, wherein certain features described above will not be repeated with respect to the embodiments of FIGS. 4A-4F. Like components may be given like reference numerals.

Figure 4A:
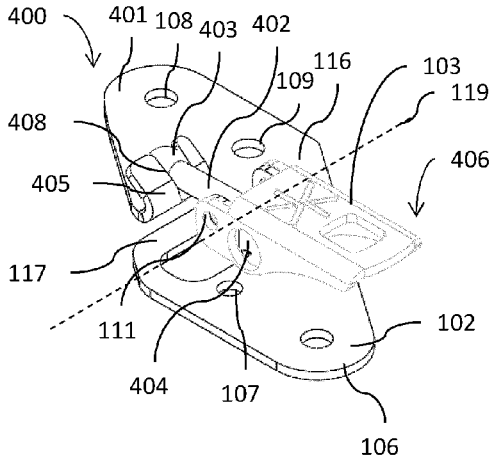
FIG. 4A is an isometric view of a fourth embodiment of a board joining device in a coupled position.

FIG. 4A is an isometric view of the board joining device 400 which can include a hook element 401 and a buckle element 406. In one embodiment, the hook element 401 can include mounting holes 108 and 109, a shear tab 116, and a forked hook 405 with a "U" shaped opening 408. In a further implementation, a buckle element 406 can include a base 102, mounting holes 106 and 107, a shear tab 117, a pivot 111, a cam lever 103 pivotally attached at the pivot 111 to the base 102, a pivot attachment 404, and a tension element 402 with a catch end 403. In some embodiments, the catch end 403 can be a spherical shape, as shown, or any other shape larger than the diameter of the tension element 402.

Figure 4B:
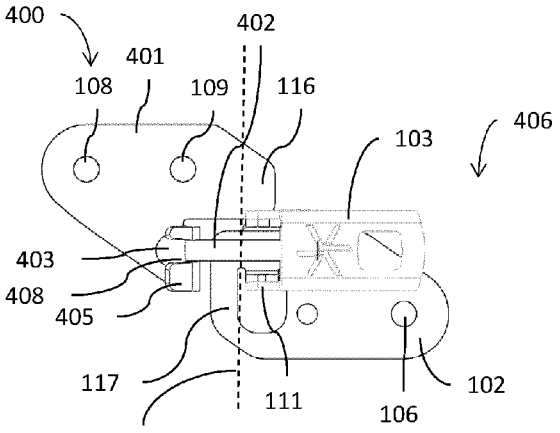
FIG. 4B is a top view of a fourth embodiment of the board joining device in a coupled position.

FIG. 4B is a top view of the board joining device 400 in the closed position. In the illustrated embodiment, the catch end 403 of the tension element 402 engages the forked hook 405. The forked hook 405 is sized such that the tension element 402 fits through the "U" shaped opening 408, while the catch end 403 does not fit through the "U" shaped opening 408.

Figure 4C:
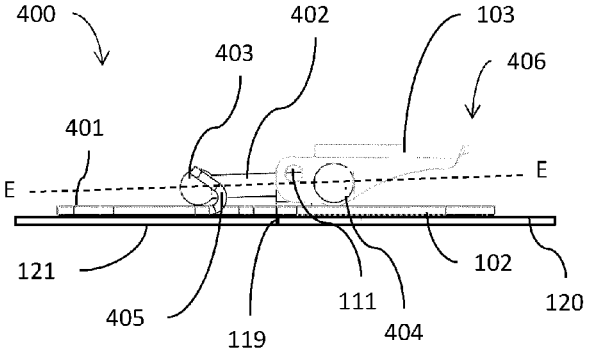
FIG. 4C is a side view of a fourth embodiment of the board joining device in a coupled position.

FIG. 4C is a side view of the board joining device 400 shown in the closed position. In particular, when the catch end 403 of the tension element 402 of the buckle element 406 engages the forked hook 405 of the hook element 401 and the cam lever 103 is in the over-center position, the first ski 121 and the second ski 120 compress together at the seam 119 to create a snowboard. Additionally, the tension element 402 may be in tension between the forked hook 405 and the pivot attachment 404. The overcenter position may be defined by a pivot attachment 404 and the catch end 403 or the tension element 402 being below the pivot 111 of the base 102. In some embodiments, the tension element 402 is in tension along the line of action E which is not horizontal, thereby pulling the first ski 121 up into the shear tab 117 of the buckle element 105 and pulling the second ski 120 into the shear tab 116 of the hook element 401 (seen for example in FIG. 4A). The tension along line of action E in tension element 402 creates horizontal compression between the skis 120 and 121, creates vertical compression between the first ski 121 and the shear tab 117 of the buckle element 105, and creates vertical compression between the second ski 120 and the shear tab 116 of the hook element 401.

Figure 4D:
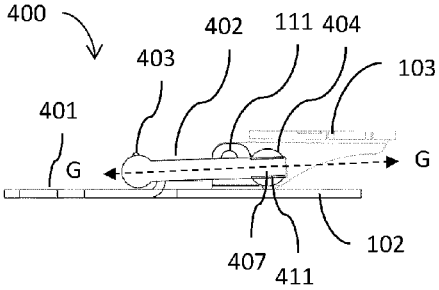
FIG. 4D is a side section view of a fourth embodiment of the board joining device in a coupled position.

FIG. 4D is a cross-sectional view of the board joining device 400 shown in the closed position. In some embodiments, the tension element 402 can include a threaded end 407. The threaded end 407 may thread into the pivot attachment 404, which can have a threaded hole 411. The length of the tension element 402 can be adjusted by threading the threaded end 407 into or out of the threaded hole 411 of the pivot attachment 404 along a path represented by line "G". By decreasing the length of the tension element 402, the tension in the board joining device 400 increases when in the closed position. By increasing the length of tension element 402, the tension in board joining device 400 decreases when in the closed position.

Figure 4E:
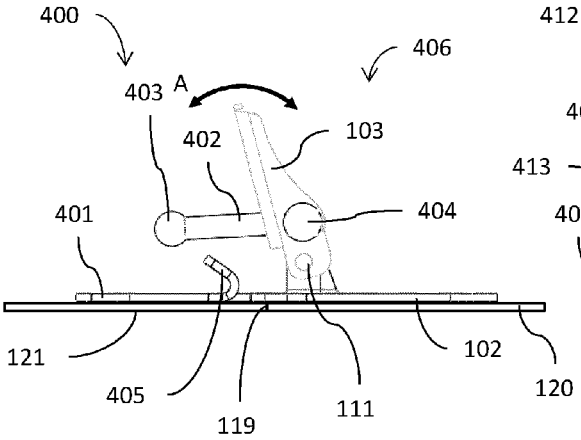
FIG. 4E is a side view of a fourth embodiment of the board joining device in an uncoupled position.

FIG. 4E shows a side view of the board joining device 400 with the hook element 401 and the buckle element 406 disengaged. The cam lever 103 of the buckle element 406 is shown rotated up along path "A" causing the catch end 403 of the tension element 402 to disengage from the forked hook 405 of the hook element 401.

Figure 4F:
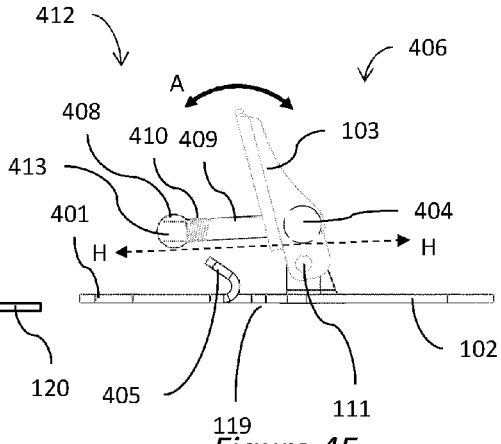
FIG. 4F is a side view of a variation of a fourth embodiment of the board joining device in an uncoupled position.

FIG. 4F shows a side view of another embodiment of the board joining device 412, which illustrates an additional example of the board joining device 400 in accordance with the present disclosure. The board joining device 412 may be similar in many respects to the board joining device 400 illustrated in FIGS. 4A-4E and described in more detail above, wherein certain features described above will not be repeated with respect to this embodiment. In the embodiment of FIG. 4F, a tension element 409 (similar to the tension element 402 of FIG. 4A) has a threaded end 410 with a catch end 408 with a threaded through hole 413 attached thereto. The position of the catch end 408 can be adjusted along path "H" by spinning it along the threaded end 410. Moving the catch end 408 towards the pivot attachment 404 increases tension in the board joining device 412 when in the closed position. Conversely, moving the catch end 408 away from the pivot attachment 404 decreases tension in the board joining device 412 when in the closed position.

Figure 5A:
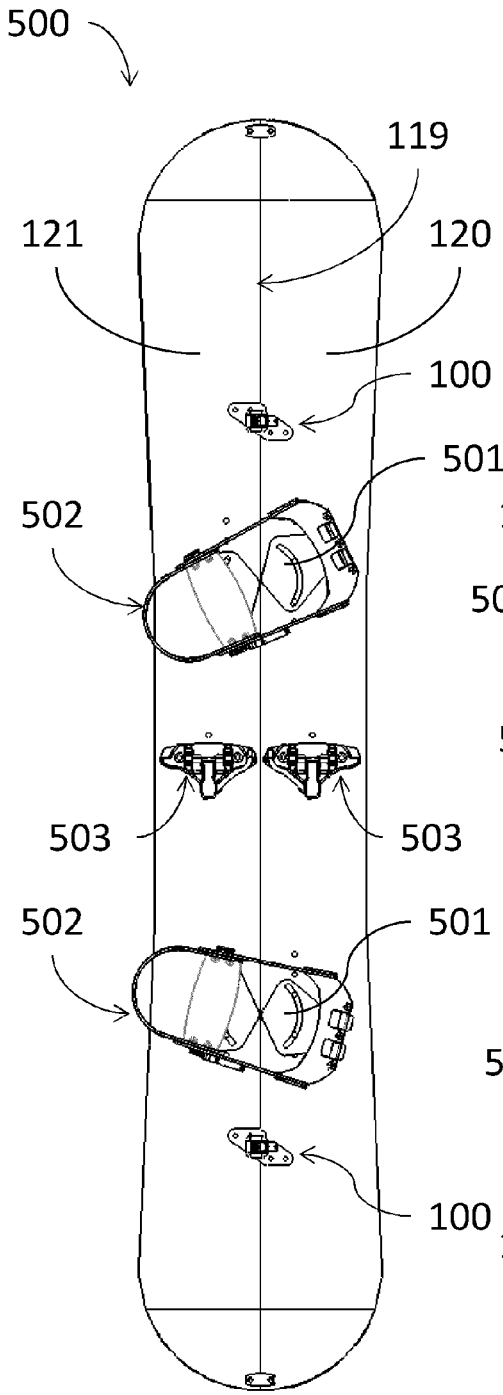
FIG. 5A is a top view of a splitboard in a snowboard configuration with a board joining device in a coupled position.
Figure 5B:
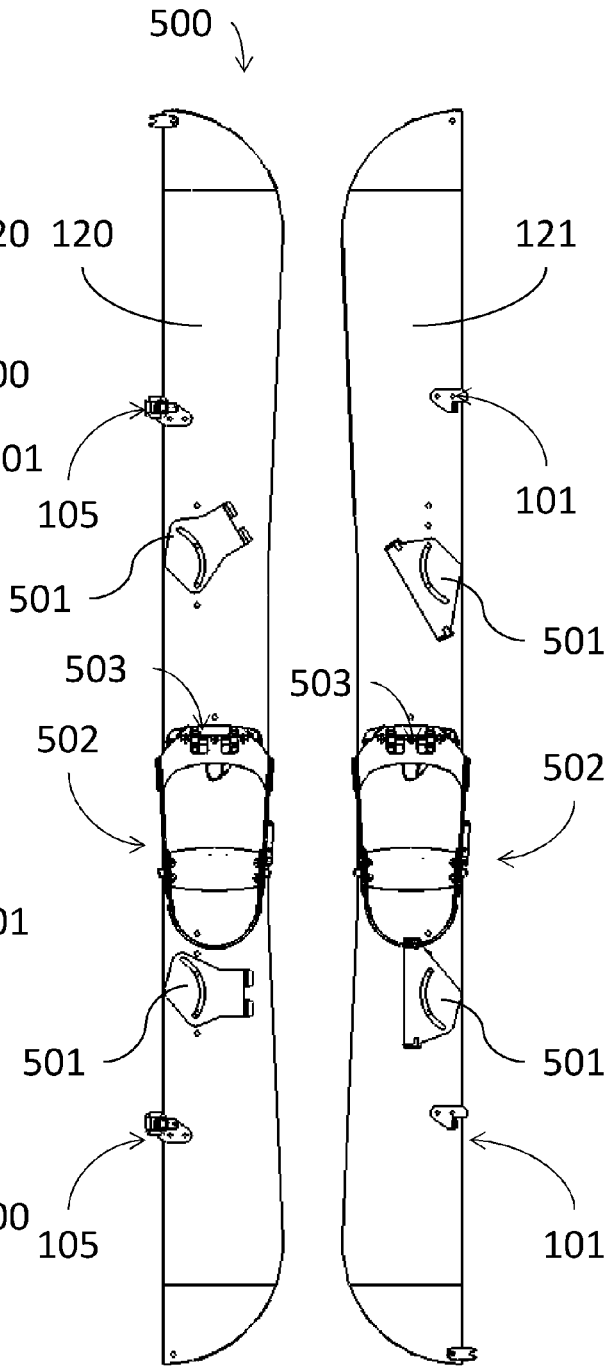
FIG. 5B is a top view of a splitboard in a ski configuration with the board joining device in an uncoupled position.

FIGS. 5A and 5B show a splitboard 500 with a board joining device 100 attached. The board joining device securely joins a first ski 121 and a second ski 120 to create a snowboard. In some embodiments, the board joining device 100 can be replaced with board joining device 200 of FIGS. 2A through 2F. In some embodiments, the joining device 100 can be replaced with board joining device 300 of FIGS. 3A through 3D. In some embodiments, the joining device 100 can be replaced with board joining device 400 of FIGS. 4A through 4E. In some embodiments, the joining device 100 can be replaced with board joining device 412 of FIG. 4F.

FIG. 5A shows a top view of the splitboard 500 with the first ski 121 and the second ski 120 in the snowboard configuration, with the board joining device 100 in a coupled position. The splitboard 500 has a seam 119 between the first ski 121 and the second ski 120. FIG. 5B shows a top view of the splitboard 500 with the first ski 121 and the second ski 120 in the ski touring configuration with the board joining device 100 in the uncoupled position. In some embodiments, the board joining device 100 consists of a hook element 101 on either the first or second ski and a buckle element 105 on the opposing ski.

FIG. 5A shows the splitboard 500 in a snowboard configuration. The splitboard 500 can have bindings 502 for attaching a user's feet to the snowboard. The bindings 502 are attached to the splitboard 500 through ride mode interfaces 501. In a further implementation, the splitboard 500 can have tour mode interfaces 503. FIG. 5B shows the splitboard 500 in a ski configuration with the bindings 502 attached to tour mode interfaces 503. In the ski figuration, in some embodiments, a user can walk up the hill with bindings 502 pivoting about tour mode interface 503.

Figure 6A:
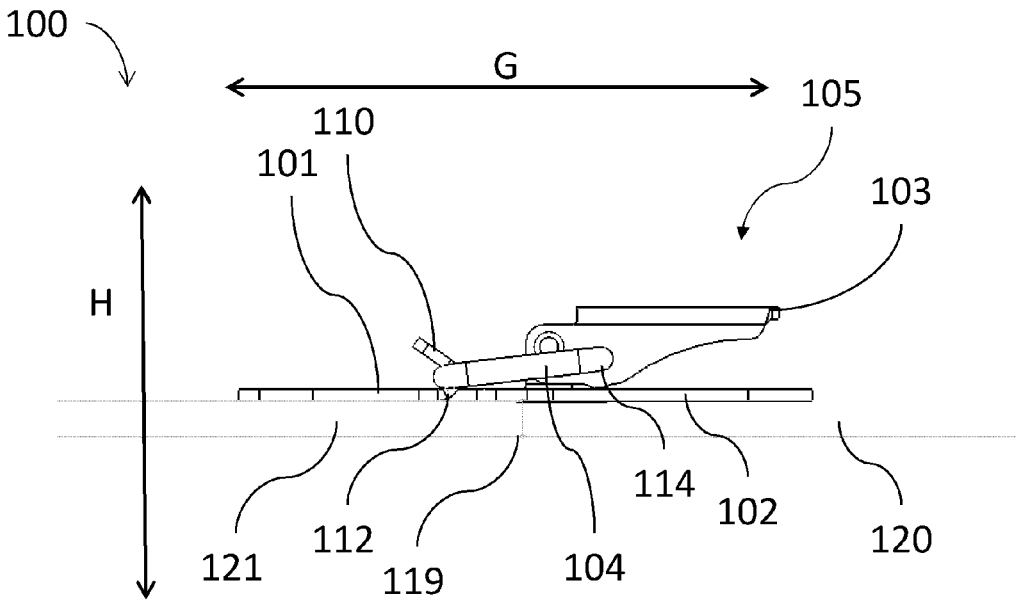
FIG. 6A is a side view of an embodiment of a splitboard joining device.
Figure 6B:
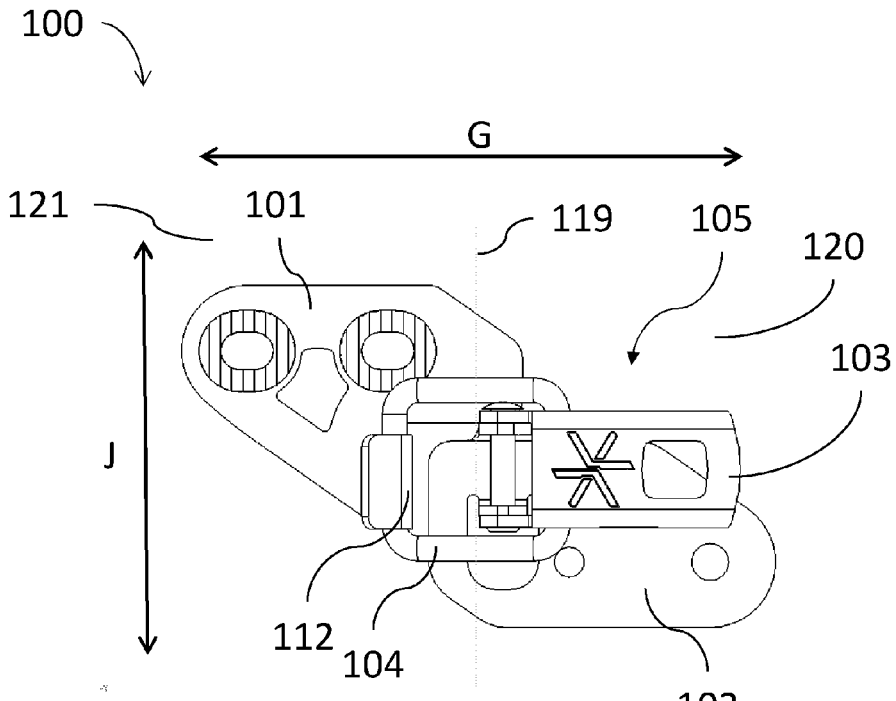
FIG. 6B is a top view of the embodiment of the splitboard joining device of FIG. 6A.

FIG. 6A shows a side view of an example embodiment of a splitboard joining device 100 described in FIGS. 1A through 1D. Path G is substantially perpendicular to the seam 119 of the splitboard 500. Path H is substantially vertical with respect to the seam 119 of the splitboard 500. FIG. 6B shows a top view of an example embodiment of the splitboard joining device 100. Path G is substantially perpendicular to the seam 119 of the splitboard 500, while path J is substantially parallel with respect to the seam 119.

Embodiments of the splitboard joining devices, and components thereof, disclosed herein and described in more detail above may be manufactured using any of a variety of materials and combinations thereof. For example, in some embodiments, one or more metals, such as, for example, aluminum, stainless steel, steel, brass, titanium, alloys thereof, other similar metals, and/or combinations thereof may be used to manufacture one or more of the components of the splitboard binding apparatus and systems of the present disclosure. In some embodiments, one or more plastics may be used to manufacture one or more components of the splitboard binding apparatus and systems of the present disclosure. In yet further embodiments, carbon-reinforced materials, such as carbon-reinforced plastics, may be used to manufacture one or more components of the splitboard binding apparatus of the present disclosure. In additional embodiments, different components using different materials may be manufactured to achieve desired material characteristics for the different components and the splitboard binding apparatus as a whole.

Some embodiments of the apparatus, systems, and methods disclosed herein may use or employ apparatus, systems, methods, components, or features disclosed in U.S. patent application Ser. No. 12/604,256, which was filed on Oct. 22, 2009 and was published as U.S. Patent Publication No. 2010/0102522 on Apr. 29, 2010, entitled "Splitboard Binding Apparatus," the entire content of which is hereby incorporated by reference in its entirety. Some embodiments of the apparatus, systems, and methods disclosed herein may use or employ apparatus, systems, methods, components, or features disclosed in U.S. patent application Ser. No. 13/458,560, which was filed on Apr. 27, 2012 and was published as U.S. Patent Publication No. 2012/0274036 on Nov. 1, 2012, entitled "Splitboard Binding Apparatus and Systems," the entire content of which is hereby incorporated by reference in its entirety.

Conditional language such as, among others, "can," "could," "might," or "may," unless specifically stated otherwise, are otherwise understood within the context as used in general to convey that certain embodiments include, while other embodiments do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

It should be emphasized that many variations and modifications may be made to the embodiments disclosed herein, the elements of which are to be understood as being among other acceptable examples. Accordingly, it should be understood that various features and aspects of the disclosed embodiments can be combined with or substituted for one another in order to form varying modes of the disclosed apparatus, systems, and methods. All such modifications and variations are intended to be included and fall within the scope of the embodiments disclosed herein.

What is claimed is:

1. A splitboard joining device for releasably coupling at least two separate portions of a splitboard, creating a snowboard when coupled and at least a first ski and a second ski when uncoupled, the device comprising:

a first interface configured to attach to a first portion of a splitboard, the first interface having at least one hook element and at least one tab element, the at least one tab element of the first interface configured to extend past an inside edge of a first portion of the splitboard and over a second portion of the splitboard to limit upward movement of the second portion of the splitboard;

a second interface configured to attach to the second portion of a splitboard, the second interface having at least one latch element and at least one tab element, the at least one tab element of the second interface configured to extend past an inside edge of the second portion of the splitboard and over the first portion of the splitboard to limit upward movement of the first portion of the splitboard;

wherein the at least one latch element of the second interface is configured to engage the hook element of the first interface to releasably couple the first portion and the second portion of the splitboard;

wherein the at least one latch element of the second interface comprises a lever configured to rotate about a pivot for engaging and disengaging by hand without the use of an external tool the latch element of the second interface with the at least one hook element of the first interface; and an adjustable tension element configured to adjustably control the tension between the first interface and second interface, and configured to adjustably control the compression between the first and second portions of the splitboard when coupled;

wherein the adjustable tension element is configured such that to increase tension the at least one hook element can move in a direction from the seam of the splitboard toward the hook's mounting point or the at least one latch element can move in a direction from the seam of the splitboard toward the latch's mounting point;

wherein the adjustable tension element is configured such that to decrease tension the at least one hook element can move in a direction from the hook's mounting point toward the seam of the splitboard or the at least one latch element can move in a direction from the latch's mounting point toward the seam of the splitboard; and wherein the at least one hook element or the at least one latch element is configured to be fixed in place at a desired tension between the first interface and the second interface.

2. The splitboard joining device of claim 1, wherein the adjustable tension element is part of the first interface, the adjustable tension element comprising at least one slotted mounting hole for adjusting the position of the first interface relative to the second interface, wherein the first interface is held in the adjusted position by a fastener and wherein moving the second interface closer to the first interface decreases tension and wherein moving the second interface away from the first interface increases tension.

3. The splitboard joining device of claim 1, wherein the adjustable tension element is part of the first interface, the adjustable tension element comprising at least one slotted mounting hole with scallops for adjusting the position of the first interface relative to the second interface, wherein the first interface is held in the adjusted position by a fastener captured by the scallops and wherein moving the second interface closer to the first interface decreases tension and wherein moving the second interface away from the first interface increases the tension.

4. The splitboard joining device of claim 1, wherein the adjustable tension element is part of the second interface, wherein when the latch element is an over-center latch, wherein the adjustable tension element is part of the latch element further comprising a tension arm, a catch piece, and a tension arm pivot, wherein when the first and second interfaces are coupled the catch piece engages the hook element of the first interface creating tension between the first and second interfaces, and wherein the catch piece is adjustable along the tension arm to adjust the tension between the first and second interface.

5. The splitboard joining device of claim 1, wherein the adjustable tension element is part of the second interface, wherein when the latch element is an over-center latch, wherein the adjustable tensioning element is part of the latch element further comprising a tension arm, a catch piece, and a tension arm pivot, wherein when the first and second interfaces are coupled the catch piece engages the hook element of the first interface creating tension between the first and second interfaces, and wherein the tension arm is adjustably attached to the tension arm pivot to adjust the tension between the first and second interface.

6. The splitboard joining device of claim 1, wherein the adjustable tension element is part of the first interface and wherein the hook element comprises an adjustably bendable hook, wherein an opening of the adjustably bendable hook can be increased to decrease tension between the first interface and second interface, and wherein the opening of the adjustably bendable hook can be decreased to increase tension between the first and second interface.

7. The splitboard joining device of claim 1, wherein when the first and second interface are coupled, the act of coupling creates tension between the first interface and second interface, creates compression between at least the first splitboard portion and second splitboard portion, creates compression between a first portion of a splitboard and the second interface, and creates compression between a second portion of a splitboard and the first interface.

8. A splitboard comprising the splitboard joining device of claim 1.

9. The splitboard joining device of claim 1, wherein the adjustable tension element is disposed on either the first interface or the second interface.

10. The splitboard joining device of claim 1, wherein the adjustable tension element is part of both the first interface and the second interface.

11. The splitboard joining device of claim 1, wherein the adjustable tension element is configured such that to increase tension the at least one hook element can move in a direction from the seam of the splitboard toward the hook's mounting point.

12. The splitboard joining device of claim 1, wherein the adjustable tension element is configured such that to increase tension the at least one latch element can move in a direction from the seam of the splitboard toward the latch's mounting point.

13. The splitboard joining device of claim 1, wherein the adjustable tension element is configured such that to decrease tension the at least one hook element can move in a direction from the hook's mounting point toward the seam of the splitboard.

14. The splitboard joining device of claim 1, wherein the adjustable tension element is configured such that to decrease tension the at least one latch element can move in a direction from the latch's mounting point toward the seam of the splitboard.

15. The splitboard joining device of claim 1, wherein the at least one hook element is configured to be fixed in place at a desired tension between the first interface and the second interface.

16. The splitboard joining device of claim 1, wherein the at least one latch element is configured to be fixed in place at a desired tension between the first interface and the second interface.

17. The splitboard joining device of claim 2, wherein the adjustable tension element of the first interface has at least one friction surface surrounding the at least one slotted mounting hole, wherein the friction surface is configured to provide more grip between the fastener and the first interface to prevent the first interface from sliding closer to the second interface when the at least one latch element of the second interface engages the hook element of the first interface.

18. The splitboard joining device of claim 17, wherein the adjustable tension element of the first interface further comprises a deformable washer to provide additional friction between the head of the fastener and the friction surface.

19. The splitboard joining device of claim 17, wherein the friction surface comprises a tooth pattern.

20. The splitboard joining device of claim 17, wherein the friction surface comprises a textured surface.

21. The splitboard joining device of claim 17, wherein the latch element of the second interface is an over-center latch.

22. The splitboard joining device of claim 18, wherein the adjustable tension element of the first interface further comprises a washer with a friction surface to engage friction surface surrounding the slotted mounting hole.

23. A splitboard joining device for releasably coupling at least two portions of a splitboard, creating a snowboard when coupled and at least a first ski and a second ski when uncoupled, the device comprising:

a first interface configured to attach to a first portion of a splitboard, the first interface having at least one hook element and at least one tab element, the at least one tab element configured to extend past an inside edge of the first portion of the splitboard and over a second portion of the splitboard to limit upward movement of the second portion of the splitboard;

a second interface configured to attach to the second portion of the splitboard, the second interface having at least one latch element and at least one tab element, the at least one tab element configured to extend past an inside edge of the second portion of the splitboard and over the first portion of the splitboard to limit upward movement of the first portion of the splitboard;

wherein the at least one latch element of the second interface is configured to engage the at least one hook element of the first interface to releasably couple the first portion and the second portion of the splitboard;

wherein the at least one latch element is an over-center latch comprising a lever configured to rotate about a pivot, and a loop pivotally attached to the lever;

wherein the lever is configured to engage and disengage the loop of the latch element of the second interface with the hook element of the first interface, and wherein the lever is configured to be operated by hand without the use of a tool;

wherein when the first and second interface are in the coupled position the pivot is above the line of action of the loop; and an adjustable tension element configured to adjustably control the tension between the first interface and second interface, and configured to adjustably control the compression between the first and second portions of the splitboard when coupled, wherein the at least one hook element or the at least one latch element is configured to be fixed in place at a desired tension between the first interface and the second interface.

24. The splitboard joining device of claim 23, wherein the adjustable tension element is disposed on either the first interface or the second interface.

25. The splitboard joining device of claim 23, wherein the adjustable tension element is part of both the first interface and the second interface.

26. The splitboard joining device of claim 23, wherein when the first and second interface are coupled, the act of coupling creates tension between the first interface and second interface, creates compression between at least the first splitboard portion and second splitboard portion, creates compression between a first portion of a splitboard and the second interface, and creates compression between a second portion of a splitboard and the first interface.

27. The splitboard joining device of claim 23, wherein the adjustable tension element is part of the first interface, the adjustable tension element comprising at least one slotted mounting hole for adjusting the position of the first interface relative to the second interface, wherein the first interface is held in the adjusted position by a fastener and wherein moving the second interface closer to the first interface decreases tension and wherein moving the second interface away from the first interface increases tension.

28. The splitboard joining device of claim 27, wherein the adjustable tension element of the first interface has at least one friction surface surrounding the at least one slotted mounting hole, wherein the friction surface is configured to provide more grip between the fastener and the first interface to prevent the first interface from sliding closer to the second interface when the at least one latch element of the second interface engages the hook element of the first interface.

* * * * *